US006120244A

United States Patent [19]

Fukura

[11] Patent Number: 6,120,244

[45] Date of Patent: Sep. 19, 2000

[54] STRUCTURE AND METHOD FOR INSERTING INSERTS IN STATIONARY BLADE OF GAS TURBINE

[75] Inventor: Takashi Fukura, Hyogo-ken, Japan

[73] Assignee: Mitsubishi Heavy Industries, Ltd., Tokyo, Japan

[21] Appl. No.: 09/242,290

[22] PCT Filed: Jun. 12, 1998

[86] PCT No.: PCT/JP98/02595

§ 371 Date: Feb. 11, 1999

§ 102(e) Date: Feb. 11, 1999

[87] PCT Pub. No.: WO98/57043

PCT Pub. Date: Dec. 17, 1998

[30] Foreign Application Priority Data

Jun. 13, 1997 [JP] Japan ..... 9-156797

[51] Int. Cl.[7] ..... F01D 5/14

[52] U.S. Cl. ..... 415/115; 415/116; 415/96 A; 415/96 R; 415/97 R; 29/889.721; 29/889.722; 29/889.72

[58] Field of Search ..... 415/115, 116; 416/96 R, 96 A, 97 R, 224, 95; 29/889.722, 889.721, 889.72

[56] References Cited

FOREIGN PATENT DOCUMENTS

| | | |
|---|---|---|
| 58-96103 | 6/1983 | Japan . |
| 59-85305 | 6/1984 | Japan . |
| 9-151703 | 6/1997 | Japan . |

*Primary Examiner*—Edward K. Look
*Assistant Examiner*—Hermes Rodriguez
*Attorney, Agent, or Firm*—Sughrue, Mion, Zinn, Macpeak & Seas, PLLC

[57] ABSTRACT

An insert inserting structure and a method for enabling a stationary blade of a gas turbine to withstand high temperatures of even 1500 C. in order to realize a 150° C. class gas turbine is provided. In a stationary blade of a gas turbine including a hollow opening (2, 3, 4) into which an insert (5, 6, 7) having a plurality of cooling-air ejecting apertures (8) formed in a side wall thereof is inserted to thereby cool wall surfaces of said hollow opening (2, 3, 4) with cooling air ejected from said cooling-air ejecting apertures (8), a structure for inserting an insert in a stationary blade of a gas turbine, comprising a pair of seal plates (9*a*, . . . , 9*f*) disposed on side walls of said insert (5, 6, 7) and two grooves (11*a*, . . . , 11*f*) disposed on said wall surfaces of said hollow opening (2, 3, 4) so as to receive fittingly said seal plates (9*a*, . . . , 9*f*), respectively, wherein at least one (11*b*, 11*c*, 11*d*, 11*e*) of said two grooves (11*a*, . . . , 11*f*) is provided in a seal block (10*b*, 10*c*, 10*d*, 10*e*) mounted on said wall surface.

8 Claims, 5 Drawing Sheets

STRUCTURE AND METHOD FOR INSERTING INSERTS IN STATIONARY BLADE OF GAS TURBINE

BACKGROUND OF THE INVENTION

1. Technical Field of the Invention

The present invention relates to a stationary blade of a gas turbine and in particular to a structure and a method for inserting inserts into hollow openings provided in the stationary blade of a gas turbine for cooling same.

2. Description of the Related Art

The internal portion of a stationary blade of a conventional gas turbine is provided with a front hollow opening 2, an intermediate hollow opening 3 and a rear hollow opening 4, as is shown in FIG. 4. Inserted into the hollow openings 2, 3 and 4 are a front insert 5, an intermediate insert 6 and a rear insert 7, respectively, each of which is formed as a hollow member corresponding to the hollow opening. The inserts 5, 6 and 7 are each formed of a thin plate provided with a number of cooling-air ejecting apertures 8 each having a diameter of 0.1 to 0.5 mm.

In the gas-turbine stationary blade 1 of the structure mentioned above, cooling air is supplied to the hollow portions of the inserts 5, 6 and 7 during driving of the gas turbine, wherein the cooling air passes through the cooling-air ejecting apertures 8 formed in the inserts 5, 6 and 7 to impinge onto the wall surfaces of the hollow openings 2, 3 and 4 formed in the internal portion of the gas-turbine stationary blade 1 to thereby cool the gas-turbine stationary blade 1 from the inside.

When cooling the gas-turbine stationary blade 1 from the inside in this manner, the cooling-air ejecting apertures 8 formed in the inserts 5, 6 and 7 function as orifices because of the small diameters thereof to thereby constrict the flow of the cooling air. Thus, the cooling of the gas-turbine stationary blade 1 with the cooling air can be performed efficiently and effectively.

In the conventional gas-turbine stationary blade, the wall surfaces of each of the hollow openings 2, 3 and 4 are provided with three or more projecting portions 20, as are shown in FIG. 5, wherein each of the inserts 5, 6 and 7 is held by the projecting portions 20 to allow the cooling air to flow through the space defined between the wall surface and the insert. The inserts 5, 6 and 7 have fitting structures such that they fit snugly with the projecting portions 20. Moreover, the projecting portions 20 are finished by machining so as to conform to the outer dimensions of the inserts 5, 6 and 7 so that the inserts can be reliably held.

Gas turbines have hereinbefore been operated with a combustion gas having a temperature of 1500° C. or less. Recently, however, efforts have been made to develop a gas turbine which can be operated with a combustion gas having a temperature of 1500° C. so as to enhance the efficiency of the gas turbine. In order to allow a 1500° C. class gas turbine to be employed in practical applications, the inserts have to be fabricated using a plate of Hastelloy with a thickness of 0.5 mm.

However, when the same fitting structures as the conventional ones, for holding the individual inserts 5, 6 and 7 within the hollow openings 2, 3 and 4 are adopted it is difficult to form the projection portions 20 by machining, thus making it difficult to properly position the inserts. Consequently, some portions of the gas-turbine stationary blade 1 may not be able to be sufficiently cooled to withstand the high temperature 1500° C. combustion gas.

OBJECT OF THE INVENTION

Accordingly, in order to solve the problems mentioned above, it is an object of the present invention to provide a structure and a method for inserting inserts in a stationary blade of a gas turbine, whereby insertion of the inserts in the hollow openings of the gas-turbine stationary blade makes it possible for the stationary blade to be positively sufficiently cooled so as to withstand the high temperature 1500° C. combustion gas.

SUMMARY OF THE INVENTION

To achieve the objects mentioned above, the present invention features the characteristic arrangements mentioned below.

(1) In a stationary blade of a gas turbine including a hollow opening into which an insert having a plurality of cooling-air ejecting apertures formed in a side wall thereof is inserted to thereby cool wall surfaces of said hollow opening with cooling air jets ejected from said cooling-air ejecting apertures, the present invention proposes a structure for inserting the insert in the stationary blade of the gas turbine, the structure comprising a pair of seal plates disposed on side walls of said insert and two grooves provided in said wall surfaces of said hollow opening so as to fittingly receive said seal plates, respectively, wherein at least one of said two grooves is provided in a seal block mounted on said wall surface.

As is apparent from the above, the thin seal plates each having a thickness comparable to that of the insert can be mounted on the side wall of the insert, while the thick seal blocks each having a thickness comparable to the wall of the stationary blade are mounted on the wall surface of the stationary blade. Thus, the occurrence of strain upon provisional mounting by spot welding and final mounting by brazing can be prevented, and thus each of the inserts can be mounted with high precision.

Thus, insertion of the inserts into the hollow openings, which can ensure positive cooling of the gas-turbine stationary blade, can be achieved, whereby the gas-turbine stationary blade can withstand the high temperature 1500° C. combustion gas, thus making it possible to realize a 1500° C. class gas turbine.

(2) The present invention teaches a method of inserting an insert in a stationary blade of a gas turbine, the method comprising the steps of mounting at least one seal block on a wall surface of a hollow opening of a gas-turbine stationary blade, forming grooves in said seal block and said wall surface, respectively, mounting a pair of seal plates on a side wall of the insert, and inserting said insert into said hollow opening while fitting said pair of seal plates into said grooves.

As is apparent from the above, since the seal block is mounted on the wall surface of the hollow opening of the gas-turbine stationary blade and the grooves are thereafter formed by machining, it is possible to mount the seal block to the gas-turbine stationary blade of the structure (1) proposed by the present invention as previously described, and at the same time, it is possible to mount the seal plates on the insert and form the grooves with high precision.

Thus, the insertion of the insert into the hollow opening, which ensures positive cooling of the gas-turbine stationary blade, can be achieved, as described previously in conjunction with the feature (1) of the present invention, whereby a 1500° C. class gas turbine can be realized.

DETAILED DESCRIPTION OF THE PREFERRED EMBODIMENTS

Figure 1A:
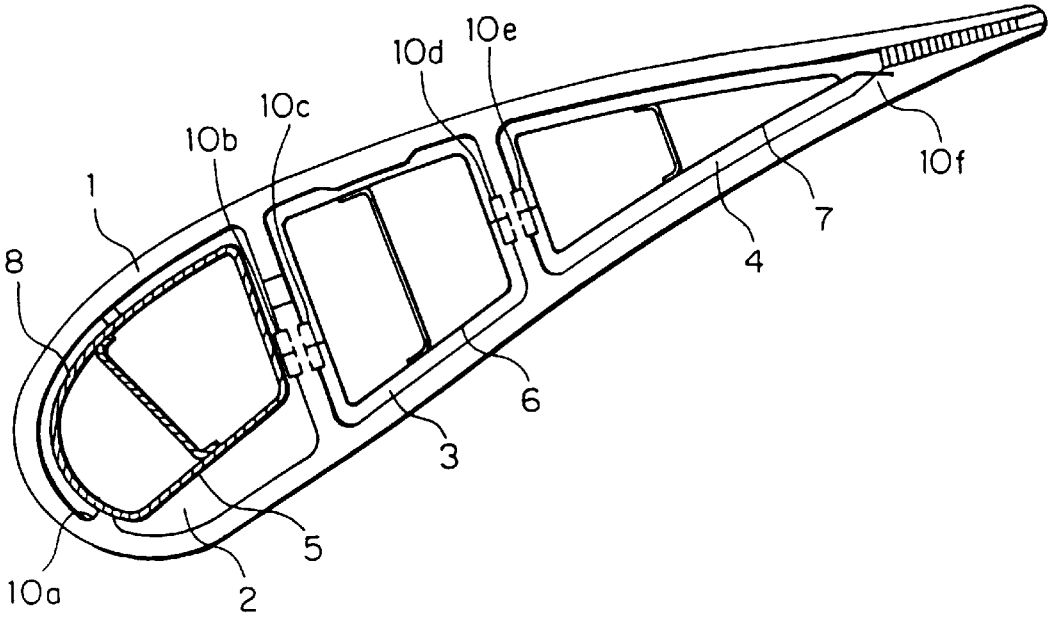
FIG. 1*a* is a plan view of a stationary blade of a gas turbine according to an embodiment of the present invention.
Figure 1B:
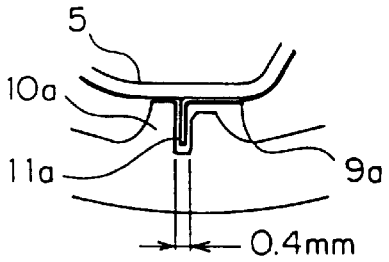
FIG. 1*b* is a view illustrating the fitting between a projecting portion and a seal plate in the structure shown in FIG. 1*a*.
Figure 1C:
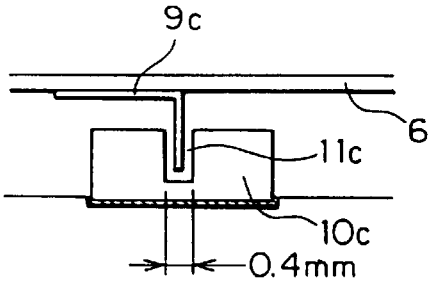
FIG. 1*c* is a view illustrating the fitting between a seal block and a seal plate (with a groove width of 0.4 mm) in the structure shown in FIG. 1*a*.

The present invention will be described in detail in conjunction with what are presently considered as preferred embodiments for carrying out the present invention with reference to the appended drawings.

In the following description, like reference numerals designate like parts throughout the drawings. Furthermore, also in the following description, it is to be understood that such terms as "right", "left", "top", "bottom" and the like are words of convenience and are not to be construed as limiting terms.

Embodiment 1

A structure for inserting inserts in a stationary blade of a gas turbine according to an embodiment of the present invention will be described with reference to FIGS. 1 and 2.

The embodiment of the present invention now under consideration is applied to a stationary blade 1 of a 1500° C. gas turbine in which a front hollow opening 2, an intermediate hollow opening 3 and a rear hollow opening 4 are provided, wherein a front insert 5, an intermediate insert 6 and a rear insert 7 each having a thickness of 0.5 mm and formed of hollow structures corresponding to the hollow openings 2, 3 and 4, respectively, are inserted into the respective hollow openings.

Figure 1D:
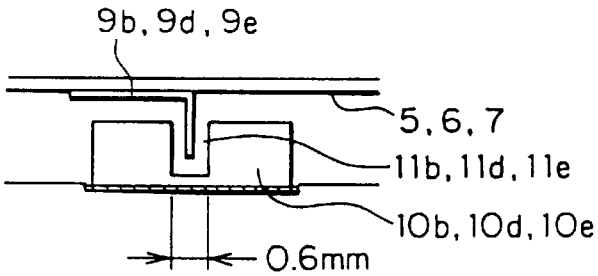
FIG. 1*d* is a view illustrating the fitting between a seal block and a seal plate (with a groove width of 0.6 mm) in the structure shown in FIG. 1*a*.
Figure 1E:
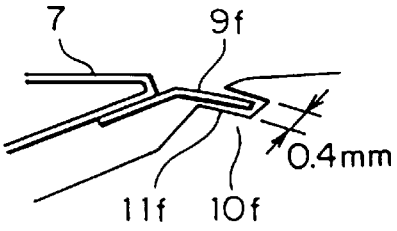
FIG. 1*e* is a view illustrating the fitting between a wall surface portion and a seal plate in the structure shown in FIG. 1i *a*.
Figure 2A:
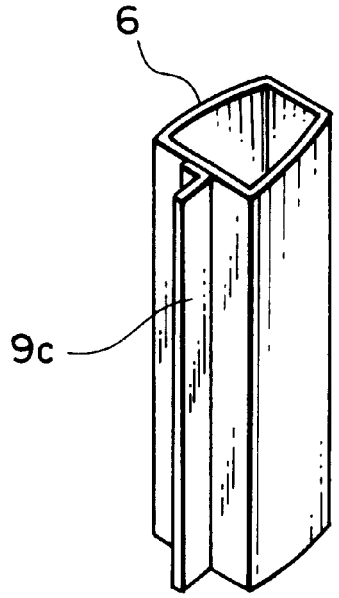
FIG. 2*a* is a view illustrating a seal plate in a state for mounting in a seal block in the structure according to the above embodiment.
Figure 2B:
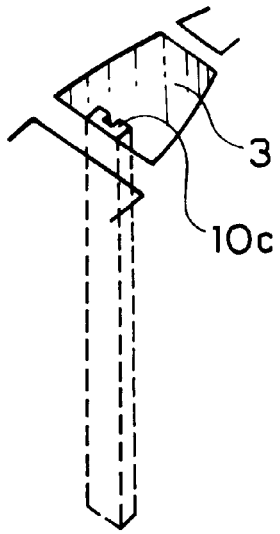
FIG. 2*b* is a view for illustrating the seal block in a state in which the seal plate is to be mounted in the seal block.

The structure for inserting the inserts in the stationary blade of the gas turbine according to the instant embodiment shown in FIGS. 1 and 2 is implemented as follows. The front hollow opening 2 has a wall surface formed at a front edge side with a projecting portion 10*a* having a groove 11*a* (see FIG. 1*a*) while a seal block 10*b* having a groove 11*b* is formed in a rib portion adjacent to the intermediate hollow opening 3 (see FIG. 1*d*). On the other hand, the front insert 5 to be inserted into the front hollow opening 2 has side walls provided with seal plates 9*a* and 9*b* at positions corresponding to those of the grooves 11*a* and 11*b* formed, respectively, in the projecting portion 10*a* and the seal block 10*b* which are provided in the front hollow opening 2 so that the seal plates 9*a* and 9*b* can be inserted into the grooves (see FIGS. 1*a* and 1*d*).

Further, the intermediate hollow opening 3 has a wall surface formed with a projecting portion 10*c* having a groove 11*c* in the rib portion adjacent to the front hollow opening 2 (see FIG. 1*c*) while a seal block 10*d* having a groove 11*d* is formed in a rib portion adjacent to the rear hollow opening 4 (see FIG. 1*d*). On the other hand, the intermediate insert 6 to be inserted into the intermediate hollow opening 3 has side walls provided with seal plates 9*c* and 9*d* at positions corresponding to those of the grooves 11*c* and 11*d* formed, respectively, in the seal blocks 10*c* and 10*d* which are provided in the intermediate hollow opening 3 so that the seal plates 9*c* and 9*d* can be inserted into the grooves (see FIGS. 1*c* and 1*d*).

Furthermore, the rear hollow opening 4 has a wall surface formed with a seal block 10*e* having a groove 11*e* in the rib portion adjacent to the intermediate hollow opening 3 (see FIG. 1*d*) while a wall surface portion 10*f* having a groove 11*f* is provided at the rear edge side (see FIG. 1*e*). On the other hand, the rear insert 7 to be inserted into the rear hollow opening 4 has side walls provided with seal plates 9e and 9f at positions corresponding to those of the grooves 11*e* and 11*f* formed, respectively, in the seal block 10*e* and the wall surface portion 10*f* provided in the rear hollow opening 4 so that the seal plates 9*e* and 9*f* can be inserted into the grooves (see FIGS. 1*d* and 1*e*).

Each of the seal plates 9*a*, . . . , 9*e* is shaped approximately in an L-shape form in order to facilitate the shaping process and the alignment thereof, wherein one leg thereof is fixedly secured to each of the inserts and the other leg is capable of being inserted into the corresponding groove of the seal block and the like formed in the wall surface of the hollow openings. The seal plate 9*f* of the rear insert 7 is however bent at an obtuse angle so as to correspond to the groove 11*f* formed in the wall surface portion 10*f* of the rear hollow opening 4, as can be seen in FIG. 1*e*. Nevertheless, the angle at which the seal plate 9*f* is bent can be changed as desired depending on the position at which the groove 11*f* is formed.

The seal blocks 10*b*, . . . , 10*e* are fixedly secured to respective seal block seats which are formed by machining corresponding wall surfaces of the respective hollow openings 2, 3 and 4, of the stationary blade 1.

Moreover, each of the seal plates 9*a*, . . . , 9*f* has a thickness of 0.25 mm, whereas the groove width of the grooves 11*a*, 11*c* and 11*f* is 0.4 mm and that of the grooves 11*b*, lid and lie is 0.6 mm.

The reason the thickness of the seal plates 9*a*, . . . , 9*f* is selected to be 0.25 mm can be explained by the fact that the above thickness is comparable to that of the inserts 5, 6 and 7, selected to be 0.5 mm, and that upon spot welding the seal plates 9*a*, . . . , 9*f* to the inserts 5, 6 and 7, respectively, in the state in which the seal plates 9*a*, . . . , 9*f* are fitted in the grooves 11*a*, . . . , 9*f*, high precision can be assured for the seal plates 9*a*, . . . , 9*f* which are provisionally secured through spot welding.

Moreover, by selecting the groove width of the grooves 11*a*, 11*c* and 11*f* to be 0.4 mm while selecting the groove width of the grooves 11*b*, 11*d* and 11*e* to be 0.6 mm, each of the inserts 5, 6 and 7 can be easily inserted into the corresponding hollow openings 2, 3 and 4, and leakage of the cooling air in the individual grooves 11*a*, . . . , 111*f* can be restrained within a predetermined range because one of the pair of seal plates 9*a*, . . . , 9*f* mounted on each of the inserts 5, 6 and 7 is inserted in the groove of 0.4 mm width while the other is inserted in the groove having the width of 0.6 mm.

Figure 3:
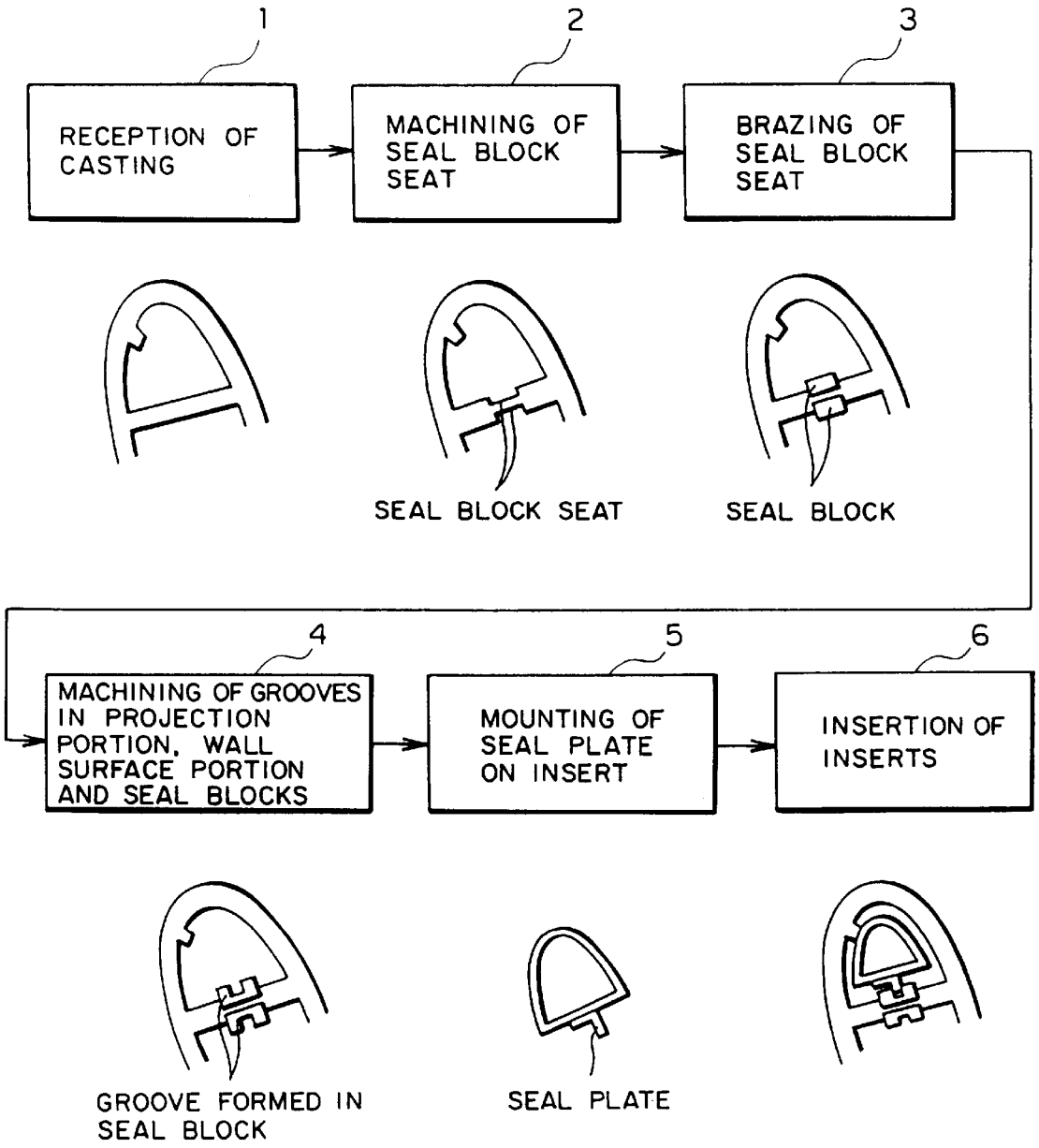
FIG. 3 is a flow-chart illustrating a method of inserting an insert in a hollow opening of a stationary blade of a gas turbine according to the embodiment.
Figure 4A:
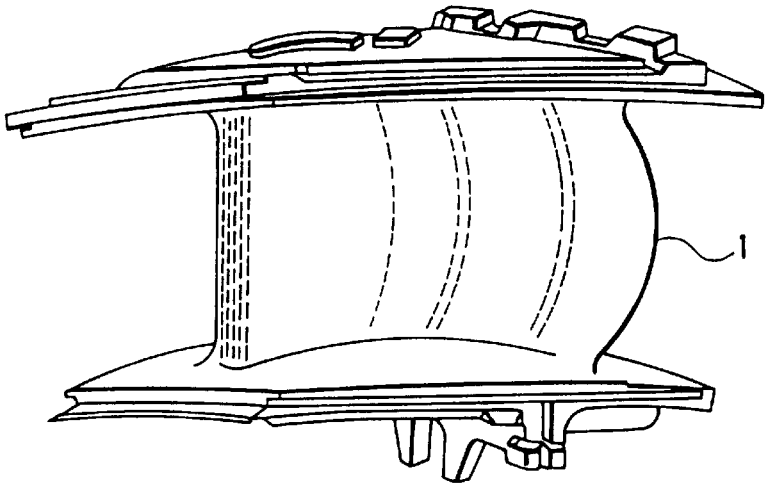
FIG. 4*a* is a view generally showing a conventional stationary blade of a gas turbine.
Figure 4B:
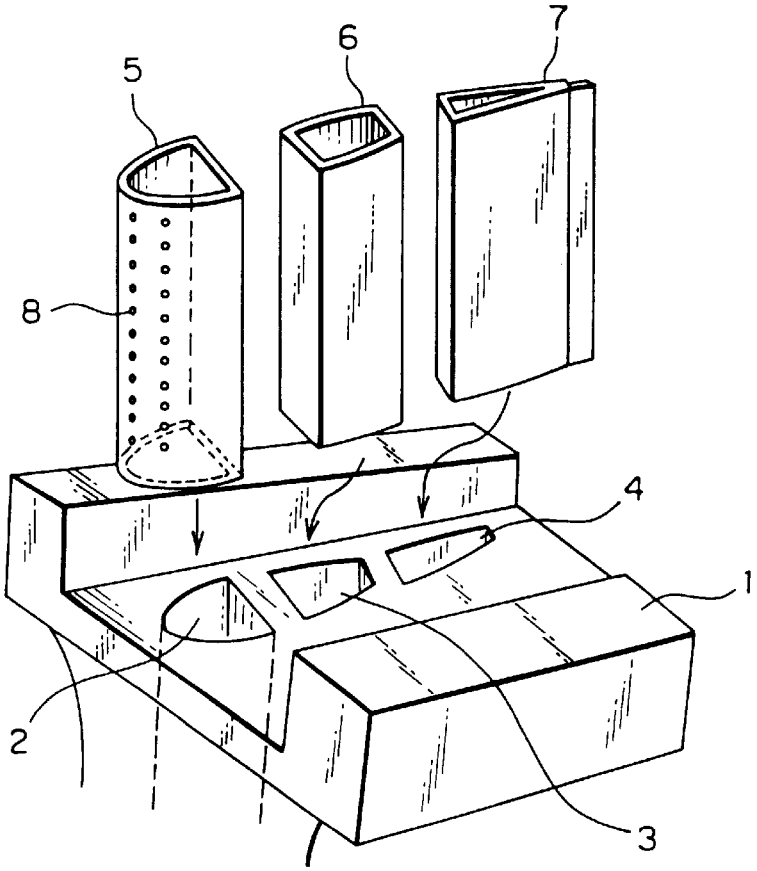
FIG. 4*b* is a view illustrating insertion of inserts into the hollow openings.
Figure 5:
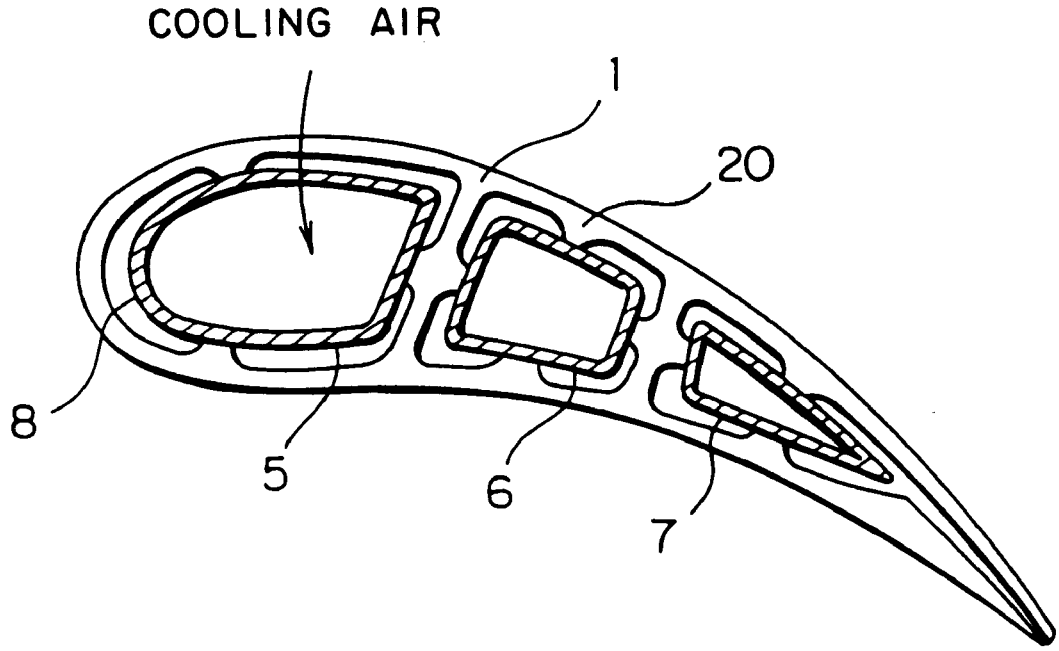
FIG. 5 is a plan view showing a conventional stationary blade of a gas turbine.

Next, the description will be directed to a method of inserting the inserts 5, 6 and 7 into the stationary blade 1 of the gas turbine according to the instant embodiment with reference to FIG. 3.

Starting from a casting of the gas-turbine stationary blade 1 being supplied (step 1), the seal block seats are formed by machining at locations where the seal blocks 10*b*, 10*c*, 10*d* and 10*e* are to be mounted, respectively (step 2).

Subsuquently, the seal blocks 10*b*, . . . , 10*e* are tacked or provisionally mounted on corresponding machined seal block seats by spot welding and then permanently secured by brazing (step 3). The permanently secured seal blocks 10*b*, 10*c*, 10*d* and 10*e* then undergo machining through a wire cutting process together with the projecting portion 10*a* and the wall surface portion 10*f*, whereby the grooves 11*a*, . . . , 11*f* are formed (step 4).

After the seal plates 9*a*, . . . , 9*f* are fitted in the respective grooves 11*a*, . . . , 11*f*, the inserts 5, 6 and 7 are inserted into the corresponding hollow openings 2, 3 and 4. After the insertion of the inserts, the seal plates 9*a*, . . . , 9*f* are provisionally attached to the inserts 5, 6 and 7 by spot welding. After completion of the spot welding, the inserts 5, 6 and 7 are withdrawn from the corresponding hollow openings 2, 3 and 4, whereupon the seal plates 9*a*, . . . , 9*f* are permanently secured through brazing (step 5).

After completion of the permanent attachment of the seal plates 9*a*, . . . , 9*f* to the inserts 5, 6 and 7, the individual inserts 5, 6 and 7 are reinserted into the corresponding hollow openings 2, 3 and 4, while fitting the seal plates 9*a*, . . . , 9*f* in the corresponding grooves 11*a*, . . . , 11*f* (step 6). Thus, the work of inserting the inserts into the hollow openings of the gas-turbine stationary blade 1 is completed.

In conjunction with the mounting process described above, it is noted that both the wall structure of the gas-turbine stationary blade 1 and the seal blocks 10*b*, . . . , 10*e* are thick. Thus, when the seal blocks 10*b*, . . . , 10*e* are attached provisionally to the respective seal block seats of the gas-turbine stationary blade 1 by spot welding and/or when the groove machining is performed on the projecting portion 10*a*, the seal blocks 10*b*, . . . , 10*e* and the wall surface portion 10*f* through the wire cutting process, strain does not occur, whereby the grooves 11*a*, . . . , 11*f* can be formed with high precision.

Furthermore, since the thickness of the seal plates 9*a*, . . . , 9*f* is 0.25 mm, which is substantially comparable to that of the 0.5 mm inserts 5, 6 and 7 as described hereinbefore, and since the seal plates 9*a*, . . . , 9*f* are fitted into the grooves 11*a*, . . . , 11*f*, respectively, and thereafter spot welding is performed, precision can be ensured for the seal plates 9*a*, . . . , 9*f* mounted provisionally on the inserts 5, 6 and 7 by spot welding.

Moreover, since a pair of seal plates are mounted on each of the inserts 5, 6 and 7, and since the groove into which one seal plate of each pair of the seal plates is inserted has the width of 0.4 mm while the width of the groove into which the other seal plate is inserted is 0.6 mm, the inserts 5, 6 and 7 can be easily inserted into the hollow openings 2, 3 and 4, respectively, and leakage of the cooling air in the grooves 11a, . . . , 11*f* can be suppressed to within a predetermined range.

By virtue of the arrangement according to the instant embodiment, precise positioning of the inserts within the respective hollow openings of the gas-turbine stationary blade can be realized while ensuring positive internal cooling of the gas-turbine stationary blade by virtue of the structure in which the seal blocks and the seal plates are employed when the inserts are inserted into the hollow openings of the gas-turbine stationary blade. Thus, the gas-turbine stationary blade can withstand the high temperature combustion gas of 1500° C., and hence a 1500° C. class gas turbine can be realized.

In the structure for inserting inserts in a stationary blade of a gas turbine according to the present invention, wherein the inserts each having a plurality of cooling-air ejecting apertures formed in the side walls are inserted into the respective hollow openings of the gas-turbine stationary blade, and in which each of the inserts is provided with a pair of seal plates disposed on the side walls thereof, and a pair of grooves which fittingly receive the seal plates, respectively, are disposed in the wall surface of the hollow opening, and at least one of the two grooves is provided in the seal block mounted on the above-mentioned wall surface, it is possible to mount the thin seal plate having a thickness comparable to that of the insert on the insert, while the thick seal blocks each having a thickness comparable to the wall thickness of the gas-turbine stationary blade can be mounted on the gas-turbine stationary blade. Thus, the occurrence of strain upon mounting can be prevented. Consequently, positioning of the inserts relative to the hollow openings of the gas-turbine stationary blade can be performed with high accuracy. Thus, insertion of the inserts into the hollow openings for ensuring positive cooling of the gas-turbine stationary blade can be achieved, making it possible to realize a 1500° C. class gas turbine.

Furthermore, owing to the method which includes the steps of mounting at least one seal block on the wall surface of the hollow opening of the gas-turbine stationary blade, forming the groove in each seal block and the above-mentioned wall surface, mounting a pair of seal plates on the side wall of the insert, and inserting the above-mentioned insert into the above-mentioned hollow opening while fitting the pair of seal plates in the corresponding grooves, the grooves can be formed with higher precision, whereby the possibility of realizing the 1500° C .class gas turbine can further be increased.

In the foregoing, the embodiment of the present invention which is considered preferable at present and alternative embodiments thereof have been described in detail with reference to the drawings. It should, however, be noted that the present invention is never restricted to these embodiments but other applications and modifications of the cooled stationary blade for the gas turbine can be easily conceived and realized by those skilled in the art without departing from spirit and scope of the present invention.

What is claimed is:

1. In a stationary blade of a gas turbine including a hollow opening into which an insert having a plurality of cooling-air ejecting apertures formed in a side wall thereof is inserted to thereby cool wall surfaces of said hollow opening with cooling air jets ejected from said cooling-air ejecting apertures, a structure for inserting an insert in the stationary blade of the gas turbine, comprising a pair of seal plates disposed on side walls of said inserts and two grooves disposed on said wall surfaces of said hollow opening so as to fittingly receive said seal plates, respectively, wherein at least one of said two grooves is provided in a seal block mounted on said wall surface.

2. A structure for inserting an insert in a stationary blade of a gas turbine as set forth in claim 1, wherein said pair of seal plates are disposed on said side walls of said insert in opposition to each other.

3. A structure for inserting an insert in a stationary blade of a gas turbine as set forth in claim 2, wherein said hollow opening includes a front hollow opening, an intermediate hollow opening and a rear hollow opening, and wherein said insert includes a front insert, an intermediate insert and a rear insert.

4. A structure for inserting an insert in a stationary blade of a gas turbine as set forth in claim 3, wherein said other groove disposed in said front hollow opening is provided in a projecting portion formed in said wall surface of said front hollow opening.

5. A structure for inserting an insert in a stationary blade of a gas turbine as set forth in claim 3, wherein said two grooves disposed in said intermediate hollow opening are provided in said seal blocks, respectively.

6. A method of inserting an insert in a stationary blade of a gas turbine, comprising the steps of mounting at least one seal block on a wall surface of a hollow opening of a gas-turbine stationary blade, forming grooves in said seal block and said wall surface, respectively, mounting a pair of seal plates on a side wall of an insert, and inserting said insert into said hollow opening while fitting said pair of seal plates in said corresponding grooves.

7. A method of inserting an insert in a stationary blade of a gas turbine as set forth in claim 6, wherein the step of mounting the seal block on the wall surface of the hollow opening of said gas-turbine stationary blade includes the steps of machining a seal block seat on said wall surface at a location at which said seal block is to be mounted on said gas-turbine stationary blade, attaching provisionally the seal block on said seal block seat by spot welding, and permanently mounting said seal block to said seal block seat by brazing.

8. A method of inserting an insert in a stationary blade of a gas turbine as set forth in claim 6, wherein the step of mounting the pair of seal plates on the side walls of said insert includes the steps of fitting said pair of seal plates in said grooves, respectively, inserting said insert into said hollow opening, attaching provisionally said pair of seal plates onto said insert by spot welding, withdrawing said insert from said hollow opening, and permanently mounting said pair of seal plates on said insert by brazing.

* * * * *